United States Patent [19]

Kryczun et al.

[11] 4,290,801

[45] Sep. 22, 1981

[54] METHOD AND INSTALLATION FOR THE COOLING OF REDUCED MATERIAL SUCH AS FINE GRAINED ORE

[75] Inventors: Alfred Kryczun; Theodor Manshausen, both of Cologne, Fed. Rep. of Germany

[73] Assignee: Klöckner-Humboldt-Deutz AG, Fed. Rep. of Germany

[21] Appl. No.: 17,550

[22] Filed: Mar. 5, 1979

[30] Foreign Application Priority Data

Mar. 3, 1978 [DE] Fed. Rep. of Germany ..... 2809172

[51] Int. Cl.[3] ..... C21B 13/02

[52] U.S. Cl. ..... 75/21; 75/82; 266/168

[58] Field of Search ..... 75/35, 21, 82; 266/168

[56] References Cited

U.S. PATENT DOCUMENTS 4,001,010 1/1977 Kanbara et al. ..... 75/35

4,067,728 1/1978 MacKay ..... 75/82

FOREIGN PATENT DOCUMENTS 517636 8/1976 U.S.S.R. ..... 266/168

*Primary Examiner*—M. J. Andrews

*Attorney, Agent, or Firm*—Hill, Van Santen, Steadman, Chiara & Simpson

[57] ABSTRACT

Method and apparatus for cooling hot reduced material output from a reduction furnace without exposing the material to oxygen in the air. A fluid-bed-cooler which receives the heated, reduced, material from the reduction furnace contains cooling pipes through which a cooling liquid is passed for indirectly cooling the reduced material. Additionally, the cooler is connected to a positive pressure reduction gas recirculating distribution system which continually passes cooled and cleaned oxygen-free reduction gases over the heated, reduced, material to be cooled. Any losses due to leaks in the recirculating reduction system, are replaced by oxygen-free reduction gas supplied from an exhaust gas port of the reduction furnace.

1 Claim, 1 Drawing Figure

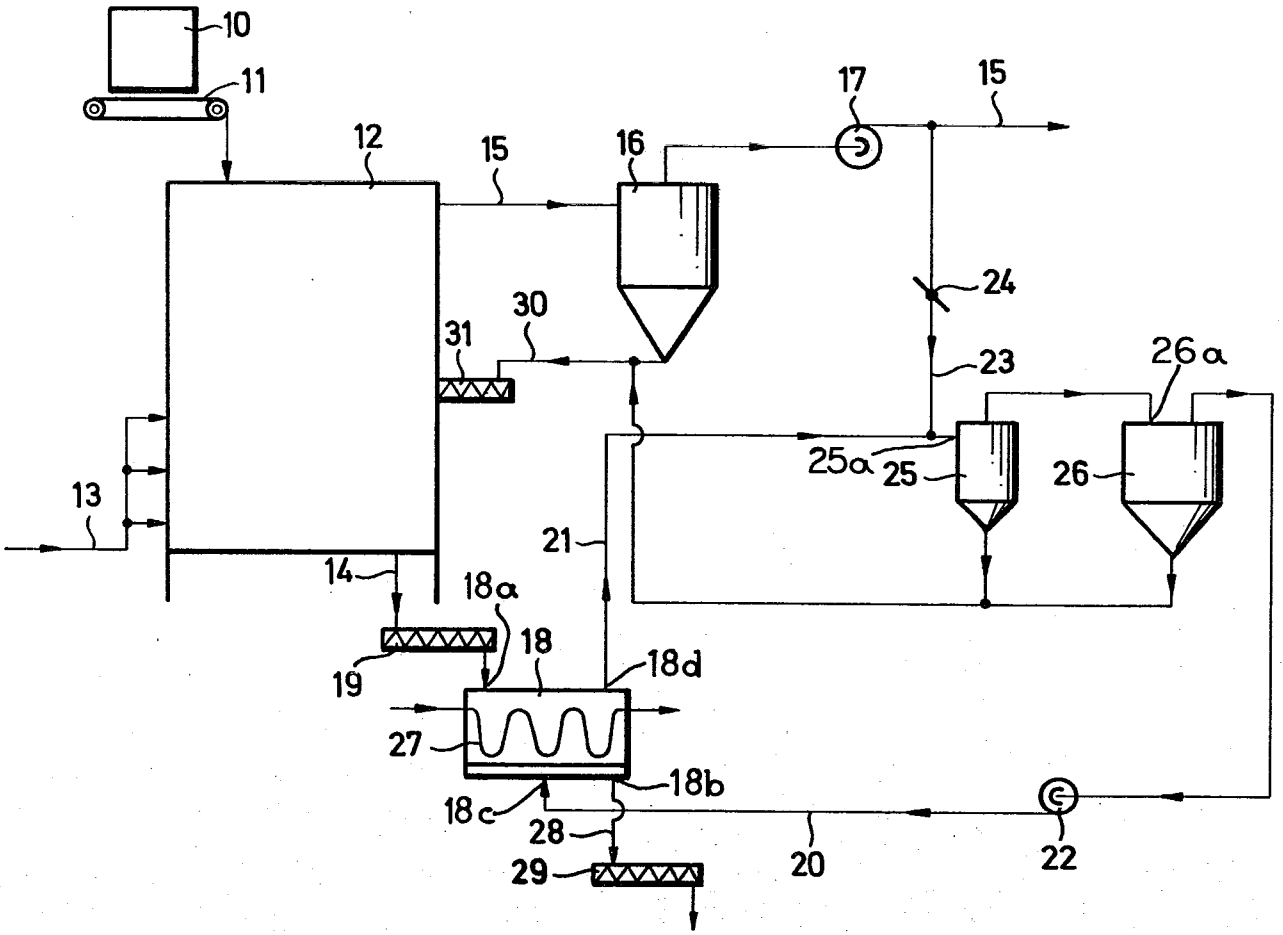
10
11
12
13
14
15
15
16
17
18
18a
18b
18c
18d
19
20
21
22
23
24
25
25a
26
26a
27
28
29
30
31

METHOD AND INSTALLATION FOR THE COOLING OF REDUCED MATERIAL SUCH AS FINE GRAINED ORE

BACKGROUND OF THE INVENTION

1. Field of the Invention

The invention relates to the field of cooling apparatus and methods for use in reduction processes.

2. The Prior Art

Prior art coolers have been of the contact type with the reduced material indirectly cooled by causing it to slide along cooled walls. Such prior art coolers have not been effective in cooling the material adequately and have suffered from safety problems due to oxygen leaking into the cooling apparatus.

There have been cases of explosions occurring in prior art coolers due to the formation of oxyhydrogen gas caused by air leaking between stationary and moving parts of the cooler.

There has been a need for a method and an apparatus for the cooling of reduced materials whereby in the cooler, a reoxidation of the reduced material as well as danger of explosion is prevented and the cooler operates safely with a high degree of effectiveness and inexpensively.

SUMMARY OF THE INVENTION

The invention relates to a method for the cooling of reduced material from reduction processes, such as reduced fine grained ore, for example, nickel-laterite. In addition, the invention relates to an installation for carrying out the method.

During the reduction of fine grained ore the ore is brought into direct contact with hot reduction gas consisting as a rule of CO and $H_2$ in a reduction furnace or reactor, such as a story furnace. The reduced material output from the furnace must be cooled before its further treatment from about 700° C., its temperature upon leaving the furnace, to about 150° C.

While being cooled, the reduced material must not be brought into contact with an oxygen-containing atmosphere. This is to prevent the material from being reoxidized.

The present invention solves this problem by cooling the reduced material in a fluid-bed-cooler, which is driven with oxygen free exhaust gas from the reduction process under a positive pressure. In the fluid-bed-cooler, the hot reduced material is cooled, both indirectly by means of interior, water cooled surfaces, as well as directly through contact with the cooling stream of gas, so that the thermal degree of effectiveness of the cooler is comparably high.

At least a part of the exhaust gas of the reduction process, which is free from oxygen, is used as the coolant gas. As a result, in the fluid-bed-cooler, the reoxidation of the reducing material is blocked as well as any formation of oxyhydrogen gas. The exhaust gas from the reduction process, in this apparatus, functions as an inert gas. As a result the production of ordinary inert gas, nitrogen for example, is not necessary. Through the operation of the fluid-bed-cooler with used reduction gas under positive pressure, no infiltrated air which would contain oxygen enters into the cooler.

According to a further feature of the invention, the gas driving the fluid-bed-cooler is constantly recirculated and is purified and again cooled before the entry into the cooler. Only the gases lost due to this recirculation process are replaced by means of additional exhaust gas supplied from the exhaust port of the reduction furnace. As a result, the major quantity of the used reduction gas leaving the reduction reactor is available for other purposes.

According to the present inventive apparatus, the output port of a reduction reactor is connected to a material input port of a fluid-bed-cooler. The fluid-bed-cooler has a series of, closed, coolant pipes inside of it over which the material to be cooled passes while a coolant circulates through the pipes. The fluid-bed-cooler has a cool gas input port and a hot gas output port. The two ports are connected into a positive pressure gas recirculation system having at least one dust remover and a gas cooler. The recirculation system is attached through a connection conduit to the exhaust gas conduit of the story furnace.

According to the present inventive method, the reduced output from the reduction furnace is first fed into a fluid-bed-cooler. For cooling purposes the reduced material, while in the fluid-bed-cooler, is exposed to the cooling pipes carrying cold water or any other such appropriate coolant. Additionally, cool, dust-free, oxygen-free reduction gases are blown across the reduced material further for the purpose of cooling it. When cool, the reduced material is then extracted from a material exit port of the fluid-bed-cooler.

The positive pressure gas recirculation system including a dust remover and a cooler along with a blower provides clean, cool reduction gases under positive pressure to the gas input port of the liquid-bed-cooler to cool the reduced material. At the gas exhaust port of the liquid-bed-cooler the exhaust gases, still within the sealed recirculation system are fed back into the dust remover.

To make up for any losses due to the fact that the gas recirculation system is operated under positive pressure, to keep out the oxygen bearing atmosphere, additional gas from the gas exhaust port of the reduction furnace may be injected into the gas recirculation system. Before being so injected, the exhaust gas is passed through a dust remover to clean it.

BRIEF DESCRIPTION OF THE DRAWING

The FIGURE is a block diagram illustrating the apparatus and method of the present invention.

DETAILED DESCRIPTION OF THE PREFERRED EMBODIMENT

Not by way of limitation but by way of disclosing the best mode of practicing our invention and also for the purpose of enabling one skilled in the art to practice our invention there is disclosed in the FIGURE one representation of the cooling apparatus and method of the present invention.

Fine grained nickel-laterite is supplied from a storage container 10 and a dosaging belt-scale 11 from above into a reduction furnace or reactor 12 constructed as story furnace. Reduction gas 13 consisting essentially of CO and $H_2$ flows through from below and upwardly within the reactor 12 in counter-current to the ore being reduced. The reduced ore is discharged from the story furnace 12 at a temperature of about 700° C. through a conduit 14. The used reduction gas is drawn off through an exhaust gas conduit 15, a dust removing cyclone filter 16 and a suction blower 17. The withdrawal of the exhaust gas is so regulated, that in the story furnace 12, an excess or positive pressure is maintained in order to prevent a penetration of atmospheric oxygen into the reactor 12.

For cooling of the reduced ore, there is connected in series with the story furnace 12, which could for example also be a shaft furnace or rotary kiln, a fluid-bed-cooler 18. The cooler 18 has a material input port 18*a* connected through a conveyor worm 19 to the discharge 14 of the story furnace. The cooler 18 also has a cooled material discharge port 18*b*.

The cooler 18 also has a gas input port 18*c* and a gas output port 18*d*. Ports 18*c* and 18*d* are each respectively connected to an input conduit and an output conduit 20, 21. Connected to the conduit 20 is a blower 22 which moves the cool gas in the conduit 20 in the direction indicated by the arrow head.

The output conduit 21 is connected to a gas input port 25*a* of a cyclone dust filter 25. Input port 25*a* is also connected by a conduit 23 through a valve 24 to the output conduit 15. The conduit 15, the cyclone filter 16 and the blower 17 act together to provide a source of clean, oxygen-free replacement reduction gas for input into the cyclone filter 25. The output of the cyclone filter 25 is connected to an input 26*a* of a cooler 26. The output of the cooler 26 is connected to the input of the blower 22.

To improve the operation of the cooler 18, a set of closed coolant pipes 27 is positioned within the cooler 18 so that the reduced ore to be cooled passes over them. A coolant liquid such as water is passed through the pipes. The reduced ore is cooled indirectly by the coolant pipes 27 and directly by the flow of clean, cool, oxygen-free gases injected into port 18*c* and removed from port 18*d* of the cooler 18.

The closed positive pressure reduction gas recirculation system comprising the fluid-bed-cooler 18, the gas output port 18*d*, the output conduit 21, the cyclone filter 25, the cooler 26, the blower 22, the conduit 20, and the gas input port 18*c* provide a mechanism whereby the coolant reduction gases may be recirculated, recleaned, and recooled again for reuse. Losses in the gas recirculation system can be replaced by tapping off the exhaust gas conduit 15 of the furnace 12 through the valve 24 and the conduit 23. Any dust or other materials extracted by the filters 16 and 25 and cooler 26 are returned by a conduit 30 through an input worm 31 to the furnace 12.

Replacement gas supplied through the conduit 23 enters the recirculating system at a temperature of about 300° C. The gas output from the cooler 26 which flows through the input port 18*c* of the fluid-bed-cooler 18 has a temperature of about 120° C. The reduced material cooled in the cooler 18, which leaves the cooler 18 by the material output port 18*b*. passes through a conduit 28 and through a transporting worm 29. The cooled, reduced material exits the cooler 18 at a temperature of about 150° C.

Although various modifications might be suggested by those skilled in the art, it should be understood that we wish to embody within the scope of the patent warranted hereon all such modifications as reasonably and properly come within the scope of our contribution to the art.

We claim as our invention:

1. An in-line method of cooling reduced fine grained ore, from a reduction process, where quantities of oxygen free reduction gases are generated by the process which comprises the steps of:

cooling and cleaning a portion of the oxygen free reduction gases, supplying reduced ore at a selected rate to an enclosed cooling chamber, continuously recirculating at a positive pressure the cooled and cleaned oxygen free reduction gases through the reduced ore in the enclosed cooling chamber, passing the ore to be cooled over a set of closed cooling pipes in the enclosed cooling chamber, circulating cooling liquid through the closed cooling pipes, removing the cooled ore from the enclosed chamber at a selected rate, removing the cooling gases from the enclosed cooling chamber and recleaning and recooling them, and replacing any oxygen free reduction gases lost during the recirculation and cooling process from the quantity generated by the reduction process.

* * * * *